US006405509B1

(12) United States Patent
Razl

(10) Patent No.: US 6,405,509 B1
(45) Date of Patent: Jun. 18, 2002

(54) LIGHTWEIGHT STRUCTURAL ELEMENT, ESPECIALLY FOR BUILDING CONSTRUCTION, AND CONSTRUCTION TECHNIQUE THEREON

(76) Inventor: Ivan Razl, Tyrŝovo nábřeží 760, 760 01 Zlín (CZ)

( * ) Notice: Subject to any disclaimer, the term of this patent is extended or adjusted under 35 U.S.C. 154(b) by 0 days.

(21) Appl. No.: 09/117,811

(22) PCT Filed: Feb. 12, 1997

(86) PCT No.: PCT/CZ97/00006

§ 371 (c)(1),
(2), (4) Date: Nov. 20, 1998

(87) PCT Pub. No.: WO97/30242

PCT Pub. Date: Aug. 21, 1997

(30) Foreign Application Priority Data

Feb. 16, 1996 (CZ) ..... PV 0473

(51) Int. Cl.[7] ..... E04C 2/38

(52) U.S. Cl. ..... 52/800.12; 52/309.12; 52/309.14; 52/309.17; 52/783.1; 52/784.1; 52/784.15; 52/794.1; 428/44; 428/116

(58) Field of Search ..... 52/782.1, 783.1, 52/794.1, 800.12, 309.7, 309.9, 309.11, 792.1, 798.1, 800.11, 309.12, 309.14, 309.17, 784.11, 784.1, 784.15; 428/109, 116, 45, 83, 88, 44

(56) References Cited

U.S. PATENT DOCUMENTS

| | | | | | |
|---|---|---|---|---|---|
| 3,748,799 | A | * | 7/1973 | Tough et al. | 52/800.12 X |
| 3,934,382 | A | * | 1/1976 | Gartung | 52/800.12 X |
| 4,084,366 | A | * | 4/1978 | Saylor et al. | 52/615 |
| 4,185,437 | A | * | 1/1980 | Robinson | 52/601 |
| 4,712,352 | A | * | 12/1987 | Low | 52/794.1 |
| 4,765,105 | A | * | 8/1988 | Tissington et al. | 52/309.11 |
| 4,807,411 | A | * | 2/1989 | Capaul | 52/794.1 X |
| 5,486,391 | A | * | 1/1996 | Tyner | 52/309.9 X |
| 5,609,006 | A | * | 3/1997 | Boyer | 52/309.7 X |
| 5,722,198 | A | * | 3/1998 | Bader | 52/309.7 X |
| 5,758,463 | A | * | 6/1998 | Mancini, Jr. | 52/309.12 |
| 5,763,043 | A | * | 6/1998 | Porter et al. | 428/109 |
| 5,848,508 | A | * | 12/1998 | Albrecht | 52/794.1 X |

FOREIGN PATENT DOCUMENTS

| | | |
|---|---|---|
| CA | 1169625 | 6/1984 |
| CA | 1284571 | 6/1991 |
| CA | 2070079 | 11/1993 |
| DE | 1484991 | 2/1969 |
| EP | 0327261 | 8/1989 |
| EP | 0615035 | 9/1994 |
| FR | 2311903 | 12/1976 |
| FR | 2470213 | 5/1981 |

* cited by examiner

*Primary Examiner*—Carl D. Friedman
*Assistant Examiner*—Yvonne M. Horton
(74) *Attorney, Agent, or Firm*—Burns, Doane, Swecker & Mathis, L.L.P.

(57) ABSTRACT

The invention relates to a light weight structural element, in particular in the shape of a panel, especially for building construction, containing a support structure. The light weight structural element contains at least two supporting rods, which at their ends are interconnected by cross-bars. Between the supporting rods and the cross-bars may be a core; wherein the surfaces of the supporting rods are interconnected by an adhesive skin made from a material of a thickness between 0.5 and 5 mm. The invention also relates to the construction technique of constructing buildings using the light weight structural elements.

15 Claims, 9 Drawing Sheets

LIGHTWEIGHT STRUCTURAL ELEMENT, ESPECIALLY FOR BUILDING CONSTRUCTION, AND CONSTRUCTION TECHNIQUE THEREON

TECHNICAL FIELD

The invention concerns panel shaped lightweight structural elements, containing internal reinforcing members, especially for constructing buildings and methods of constructing buildings composed of these elements.

BACKGROUND OF THE INVENTION

At present various kinds of material are used in building construction. Most commonly used are stone, wood, bricks, concrete, metal, plast and similar materials.

Stone buildings are strong and mostly resistant to environmental deterioration, but their principal disadvantages are, that they are a limiting factor in architectural design, that they entail slow progress of construction work, are demanding in material handling efforts, entail costly transport, do not provide a sufficient thermal insulation, etc.

The application of wood as building material opens up more architectural design possibilities, it can easily be used in constructing roofs and floors. The main disadvantages of wood is limited strength, inflammability, shorter service life, limited insulation properties etc.

Brick buildings avoid some of the above mentioned problems. The main disadvantages of bricks are relatively slow progress in construction work, demands on accuracy of workmanship, higher costs in material transport and manipulation, the necessity to provide walls with surface layers etc. Bricks are joined together with mortar (grout), which also covers the gaps between individual bricks and can be used as surface layer of plaster or stucco. Plaster surface (rendering) can be applied to the indoor as well us to the outdoor wall surface. In earlier days brick buildings normally had wooden ceilings and floors, lately concrete has partly replaced wood in these applications.

Concrete—or reinforced concrete—constructions are remarkable for their strength, are sufficiently resilient to external influences, but their heat and sound insulation parameters are rather low, transport is rather demanding, on the building site heavy building mechanisms are unavoidable, up to now the problem of disposal with these buildings after their useful service life has expired, has no satisfactory solution etc. Floors are mostly constructed using beams, external surfaces are treated so as to resist to prevailing climatic conditions, indoor surface are rendered as the customer wishes.

Also, known are some less used kinds of natural materials for building construction: e.g. earth, reeds or rushes, bamboo, straw and similar. The use of these materials is limited to selected territories.

Also known are technologies based on the use of a combination of some of the above mentioned materials. This concerns e.g. wooden or steel basic constructions, where the free spaces are built up with bricks, concrete, wood, glass, plastic or other materials. The central filling may be made of thermo-insulating material, while the external surface layers are of wood, sheet metal, plywood, stucco and other materials. Internal surfaces can be of stucco, various linings, plasterboard etc. During the last decades wooden support structures are mostly being replaced by metal supporting structures, but the basic construction methods have not changed. Floors above ground level are usually of brickwork or of wood.

From the above it can be deduced, that there are two principle classes of building construction technologies: those that are assembled on the construction site of individual construction elements, like stone, wood, bricks etc., and those, which are assembled from prefabricates, transported to the erection site as subassemblies, mostly in the form of various panels.

Prefabricated subassemblies with iron or wooden internal support structures are manufactured in a production factory and transported to the construction site, where the building is assembled either entirely using these prefabricated panels and subassemblies, or partly of subassemblies and partly of components and elements assembled on the construction site.

Panels made of steel reinforced concrete have been widely used in the large scale construction of houses. Panels, with insulating and other surface layers or without them, are used to build complete houses, including floors, ceilings and roofs.

Further are known prefabricated panels using layered elements with a load carrying surface layer. These layered elements as a rule contain load carrying surface layers and between them one or two insulating or other fillers, as for example plywood, honeycomb structures etc. An example of a known arrangement is described in the patent number CA 1,284,571 of the year 1991, filed by Peter Kayne. There is a relatively large number of patents, which are based on this construction. The difference between these patents is in principle only in the materials used, possible in the arrangement or construction of the filler material. Some patents describe also the methods used for the production of these prefabricates, as well as the methods of joining individual layers to each other.

The patent number CA 1,169,625, filed by Jack Slater, concerns the panel itself and the method of building construction using this panel. The panel contains supporting studs of either metal or of wood, between which a polystyrene block is located. These panels can be used for making walls, but also floors. The studs are joined to the fillings by commonly known kinds of glue. The inner surface is usually covered with plaster board and the outer surface with bricks or other claddings. The finishing work on internal and external surfaces is in no way connected to the studs and thus cannot transfer any supporting forces, or forces acting outside the panels, besides their own gravity-related weight.

Another example of the presently known state of the art is to be found in patent CA 2,070,079 filed by Vittorio De Zen. This patent is based on forming hollow profiles of thermoplastic materials, which it is possible to assemble in various ways, possible to fill cavities with suitable material.

An inherent disadvantage of this solution is the high cost of the machinery (tool) needed for the pressing, difficult change of panels produced, more complicated assembly, lower mechanical strength, uneasy surface treatment etc.

In summary it can be said, that building construction using small elements is demanding in time, material, work force, transport etc. Construction based on prefabricated panels will overcome some of these insufficiencies, but are usually demanding on transportation, on-site machinery, qualified personnel etc.

SUMMARY OF THE INVENTION

The above described disadvantages are largely overcome by a lightweight structural element in the shape of a panel, especially for building construction, containing a support structure according to this invention. The lightweight construction element contains at least two supporting rods, which at their end are interconnected by cross-bars, between the supporting rods and the cross bars is a core and/or the surfaces of the supporting rods are interconnected by an adhesive structural skin made from material of thickness between 0.5 and 5 mm, of direct tensile strength from 5 to 35 MPa, tensile strength in bending from 5 to 45 MPa, modulus of elasticity from 2 to 30 GPa, specific density of the matrix material 1 to 2.7 g/cm$^3$, the shear bond strength of the junction between the structural skin and the support rods is from 1 to 5 MPa and the compressive strength against pressure of the matrix material is from 10 to 70 MPa.

It is of advantage to make the lightweight structural element of at least two supporting rods of "U" profile, facing each other with their open side, possible of four rods of profile "L", facing each other with their open side.

It is of advantage, to cover the core and/or the rods with a further layer from 5 to 50 mm thick, of direct tensile strength from 0.1 to 10 MPa, tensile strength in bending from 2 to 15 MPa, modulus of elasticity from 2 to 45 GPa, specific density of the matrix material from 1 to 2.7 g/cm$^3$, the shear strength of the junction to the adhesive structural skin is from 0.1 to 5 MPa and the compressive strength against pressure of the matrix material is from 10 to 75 MPa. This further layer may contain plaster, cement, mineral fibres, perlite, vermikulite and other materials, with which desirable parameters can be attained as far as fire resistance, noise insulation etc. are concerned.

It is of advantage to make the core of polystyrene foam, extruded polystyrene, polyuretane foam, mineral wool, poro-cement, poro-silicates, honeycomb construction etc. The core can also be made of paper board, refuse material, earth, cellulose or mineral fibres.

It is of advantage to furnish an additional layer to the structural skin, with grooves for holding applied mortar.

Lightweight structural elements according to this invention can be used in such a way, that a layer identical to the structural skin material is applied to support posts and/or at least two neighbouring panels and it is of advantage to apply a further layer of this material two at least two neighbouring panels.

The advantage of this solution lies in the high value of strength of the lightweight structural element caused by the fact, that the entire lightweight structural element according to this invention behaves like one entity, because the support rods are between them firmly attached to the strong structural skin and therefore all internal and external stresses and loads are transferred to all the remaining components of this element. The ensuing construction—the hollow panel—is capable of transferring high values of stress, from bending as well as from torsion loads, in horizontal as well as in vertical directions. Thus it is possible to exploit this lightweight structural element for walls as well as for floors, ceilings or roofs. In view of the fact, that the structural skin containing anti-corrosion inhibitors firmly adheres to the supporting rods, these are protected from corrosion. Thus it is possible to use also so called "wet" materials as fillers.

The lightweight structural element according to this invention can thus be used in its basic form, i.e. as a hollow panel, but also, and especially so, as a panel with a filler, which can be chosen to meet specific needs and available materials.

The filler improves the strength of the lightweight structural element, but at the same time, using suitably selected filler material, it can be possible to attain desirable properties for the whole element. This concerns for example fire resistance, heat and sound insulation, resistance to environment etc. Buildings erected using these elements will be advantageous in extremely hot regions, e.g. the Sahara, as well as in extremely cold regions, e.g. Antarctica. Under these extreme conditions it is of advantage to use rods of "L" profile. The basic construction element thus manages to transfer loads into all rods and into the entire surface layer of the element (structural skin).

Lightweight structural elements according to this patent are light, compact for storage, strong and therefore involved transport costs are low and during erection work no heavy machinery or special mechanisms or tools are needed. Basic tools and equipment for the erection site will suffice, e.g. a concrete mixer, pump etc. Erection workers need not be fully trained specialists, but can be only superficially trained. For construction work abroad it therefore is not necessary to send out specialists from the factory, but it is possible to use local workers, who have gone through a short training course. If it is found advantageous the filling can be made of material locally available in the region of the construction site.

The lightweight structural element itself, as well as the material used during the erection, are ecologically harmless and it is possibly to reuse them. The service life of the lightweight structural elements is comparable to presently used panels, possibly even longer. Their resistance to climatic impact, including strong wind and earthquake, is comparable to that of buildings erected using classical building material, possibly even greater.

A further advantage is the ease, with which exterior as well as interior surfaces can be adjusted to the customer's desires. It is possible to finish the surfaces in a wide variety of ways, thus giving the final construction different features. These can make the building look anything from modest to luxurious, in any case it is not discernible, that the building has been made of prefabricates. Another advantage is, that the doors, windows etc. can be chosen from local suppliers. Furthermore the material is extremely resistant, fireproof, waterproof, possibly even water tight. A further advantage is, that it is possible to use the panels as substructure for poured floor mortar. This floor will be adequately strong with desired surface parameters.

A great advantage is the speed, with which the erection takes place. A complete house can be erected in 2 to 3 days with the aid of 3 to 4 workers.

A further advantage is the low price. This is caused by the fact, that the support rods are of "U" or "L" cross section. Previously known rods for reason of sufficient mechanical strength had to be of profile "C", i.e. the open end needed an additional operation of rolling in. That entails high production costs. "U" or "L" profiles are cheap to manufacture and can even be pressed, which is cheaper and simpler than other fabrication operations. In view of the simple shape of the elements used there is no problem in changing the size of the end product according to momentary needs.

BRIEF DESCRIPTION OF THE DRAWINGS

The invention and its advantages will now be explained by means of the following figures.

FIGS. 7 and 8 show a schematic cross sectional view of a house erected and portions thereof using the lightweight structural elements according to this invention.

DETAILED DESCRIPTION OF THE PREFERRED EMBODIMENTS

Figure 1:
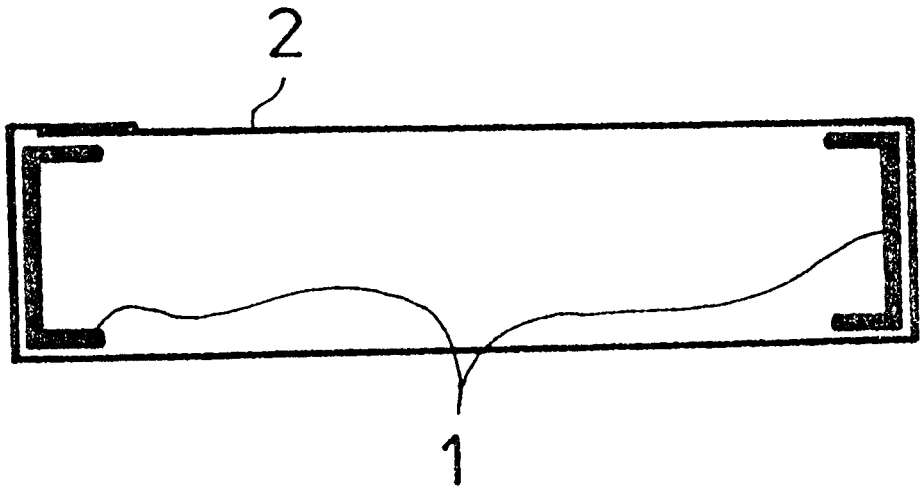
FIG. 1 shows schematically a horizontal cross section of a lightweight structural element according to this invention.
Figure 2:
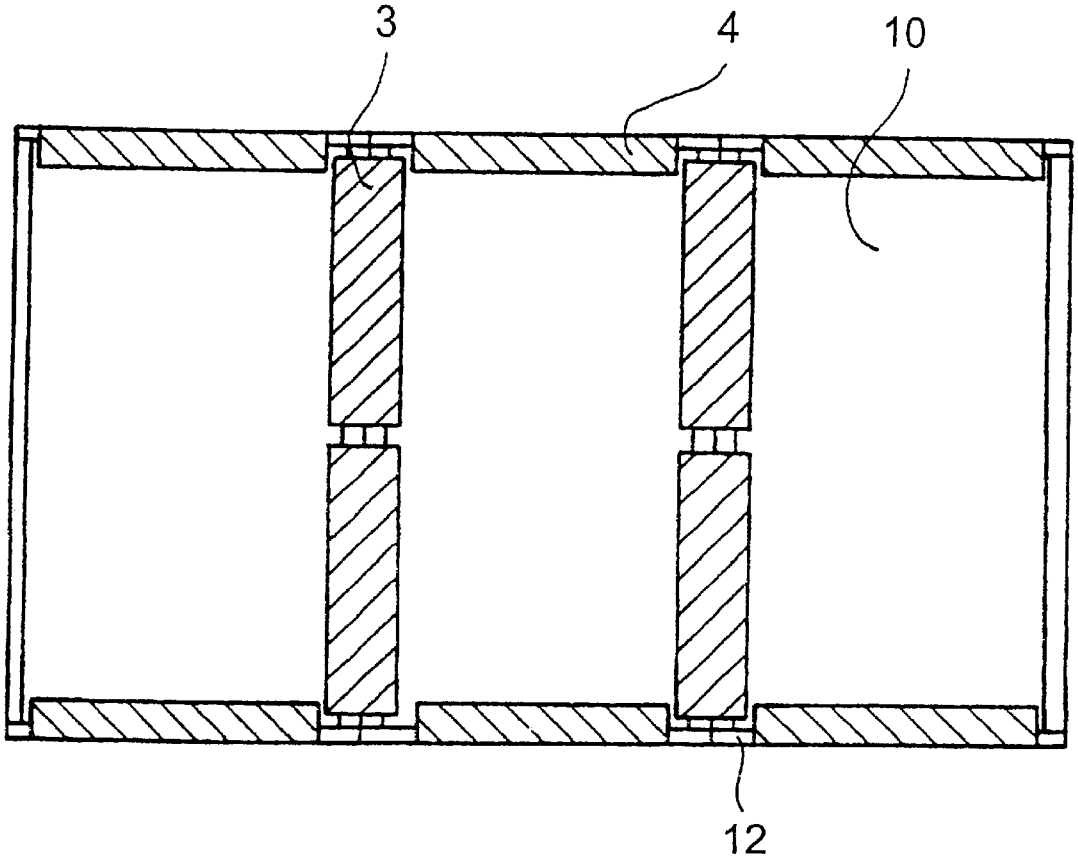
FIG. 2 shows a side view schematically in part of a wall composed of lightweight structural elements.
Figure 3:
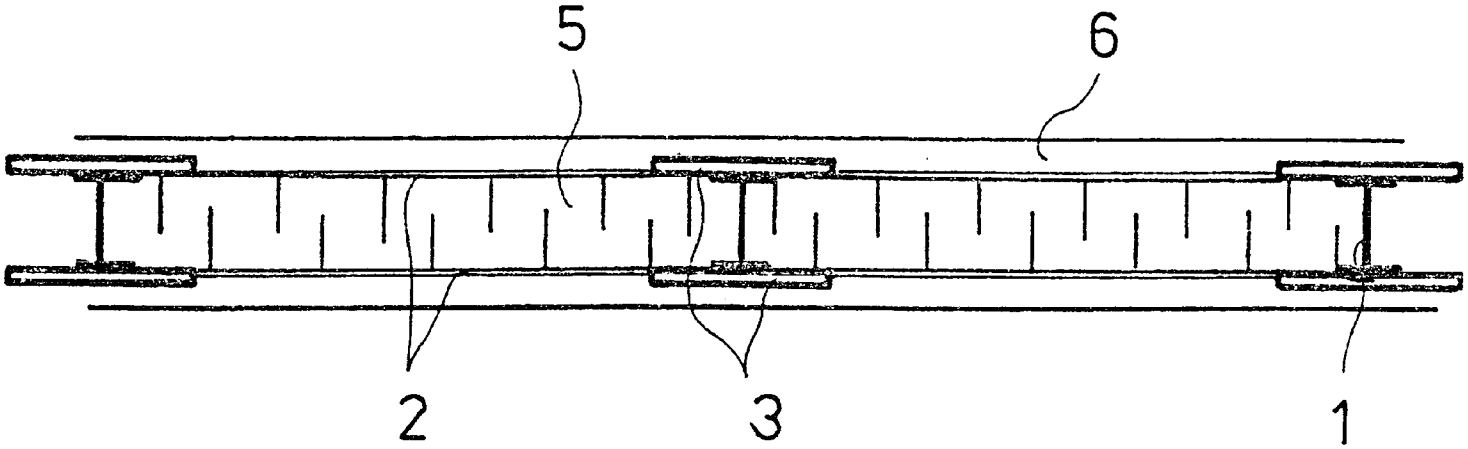
FIG. 3 shows, in plan view and cross section, part of the wall as shown in FIG. 2.
Figure 4:
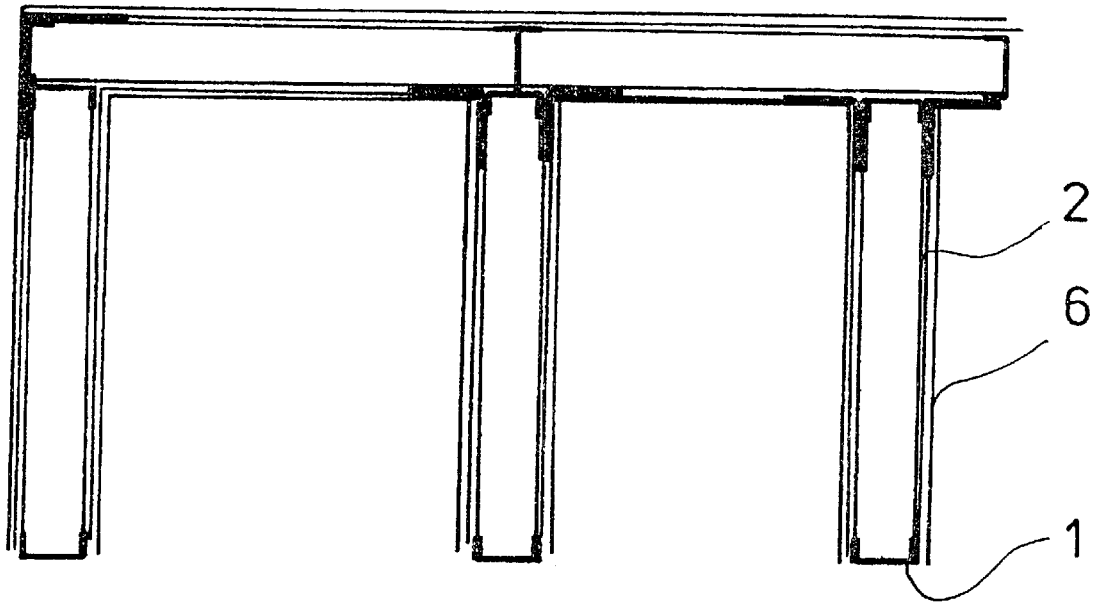
FIG. 4 shows schematically the plan view of how the lightweight structural elements are joined together to form a wall.
Figure 5:
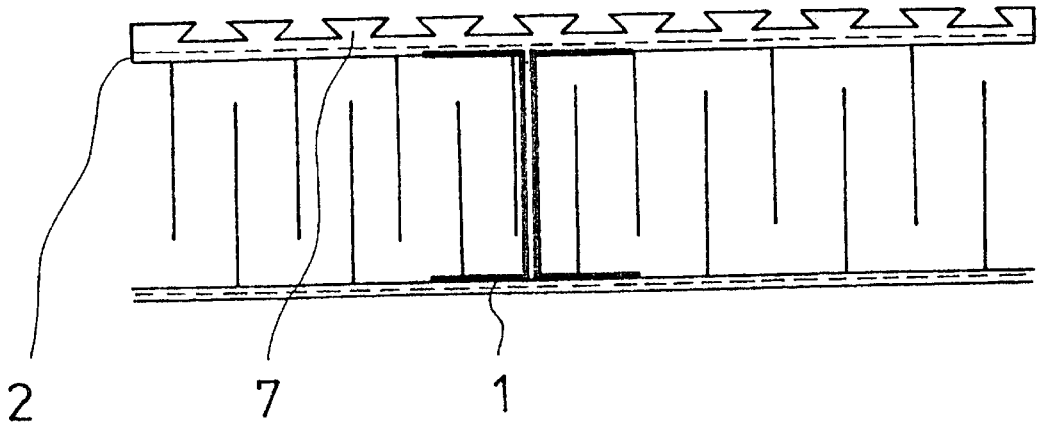
In FIGS. 5 and 6 show side views of the lightweight structural elements for use in floors.
Figure 6:
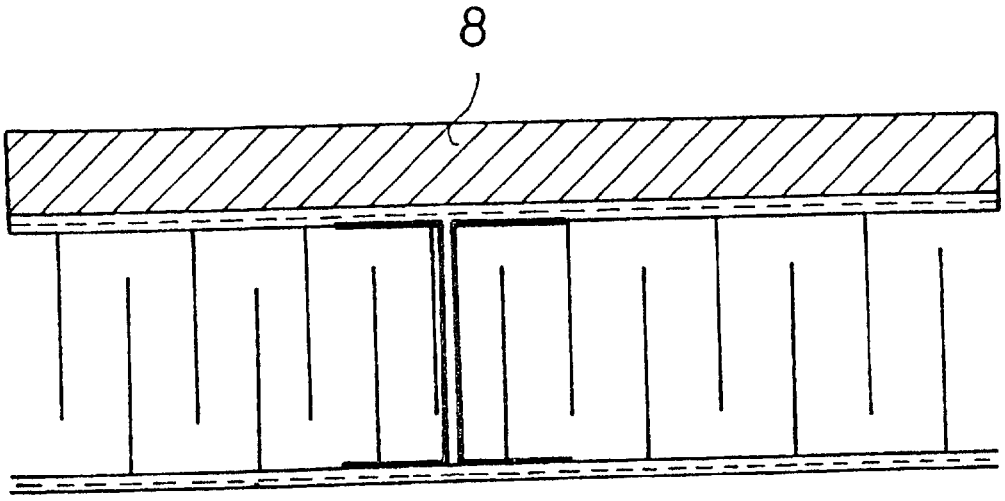
Figure 7:
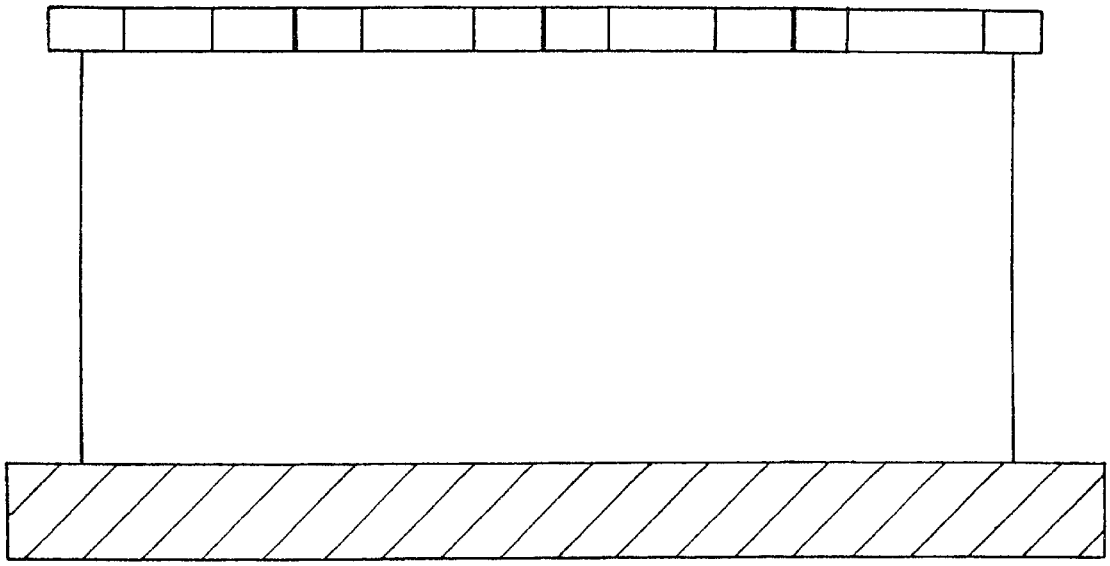
FIG. 7 shows the lightweight structural element
Figure 8:
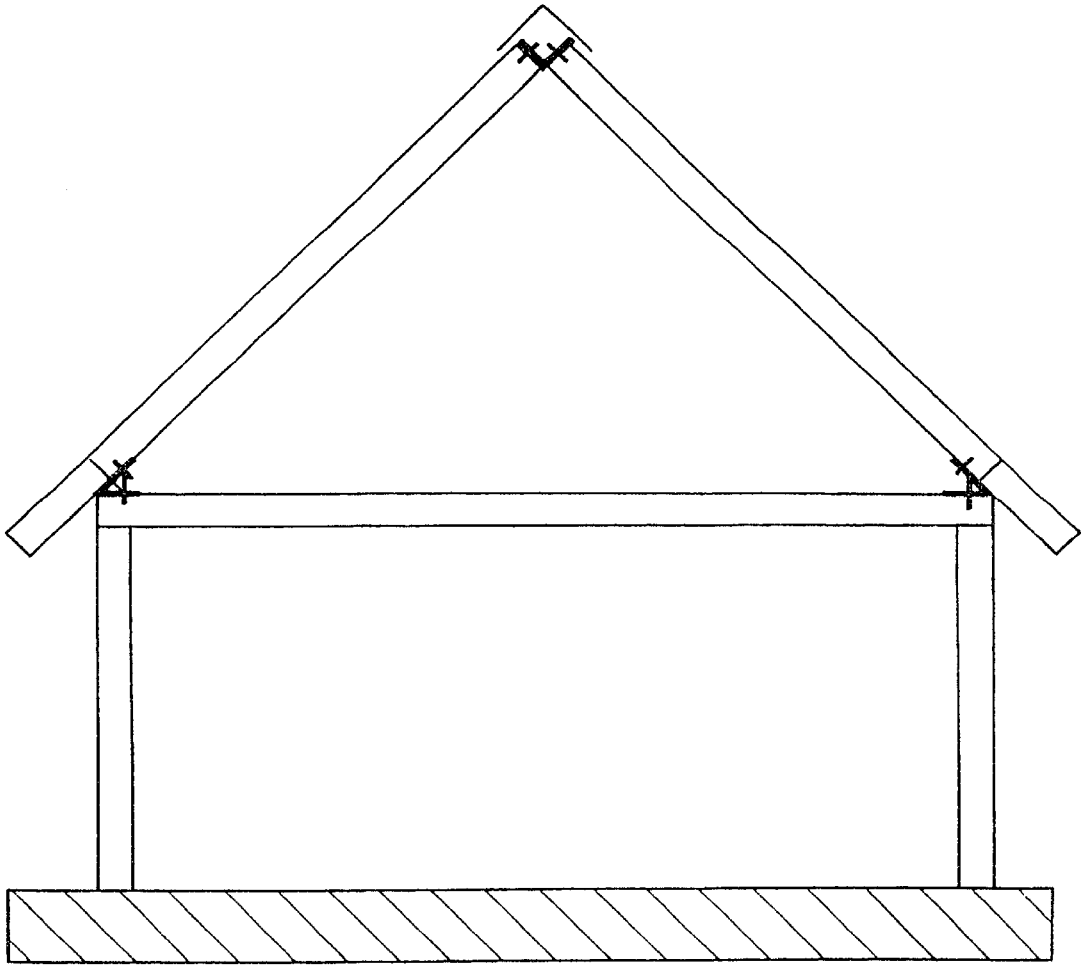
Figure 9:
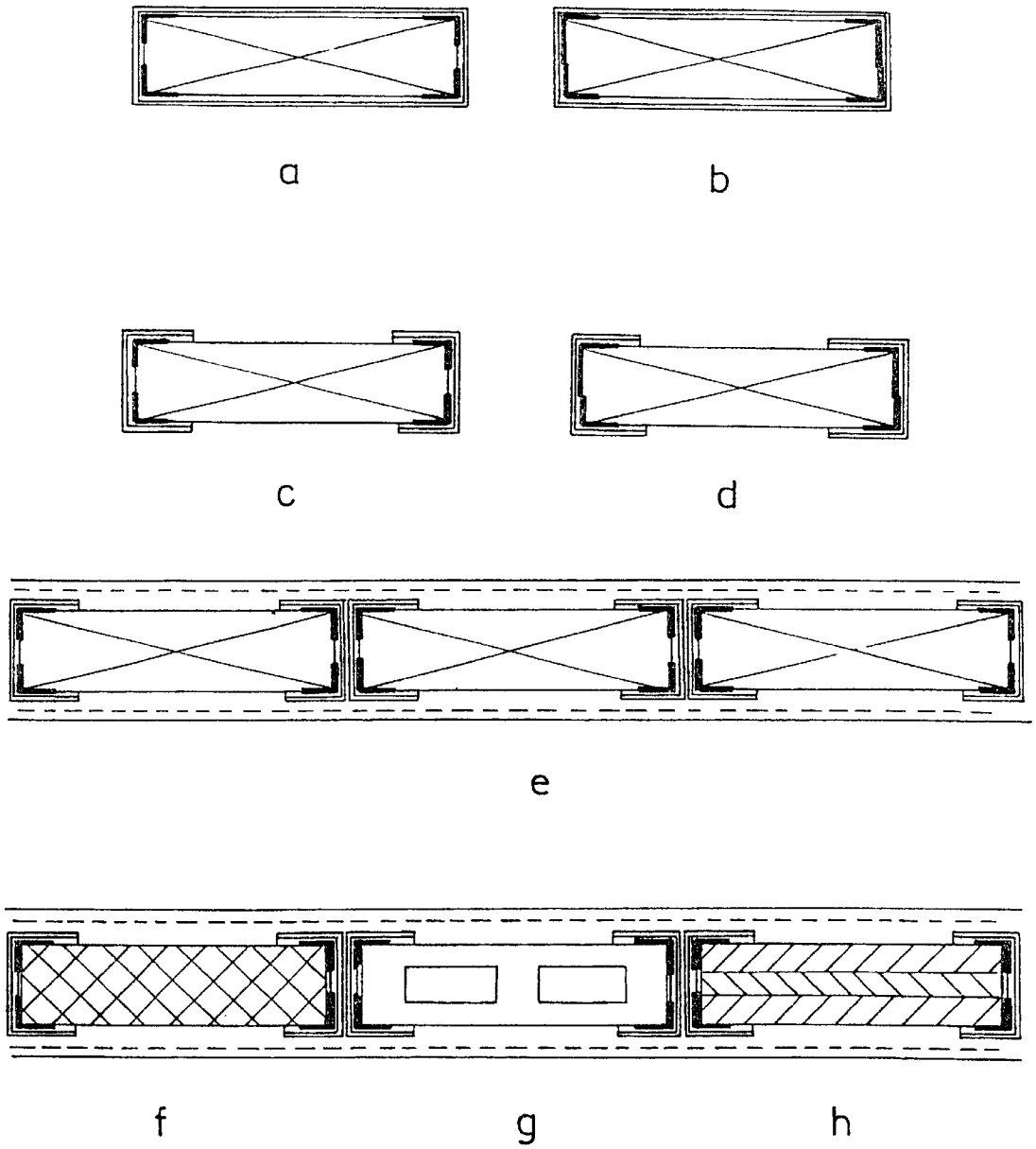
FIGS. 9*a–h* show adjacent structural elements having different core members.

The invention is described more closely with the aid of the ensuing figures, which show some examples of implementation of the invention.

The lightweight structural element in the form of a panel 10 for building construction is formed by two supporting rods 1 of galvanised steel of cross section "U" of thickness 1.2 mm, wide 100 mm and high 30 mm. The supporting rods 1 are arranged with open sides facing each other. The supporting rods 1 are on their ends mutually joined to each other by cross bars. A structural skin 2 is adhesively mounted to the supporting rods 1. The structural skin 2 material has the following physical parameters: thickness 2.5 mm, direct tensile strength 7.5 MPa, tensile strength in bending 15 MPa, modulus off elasticity 20 GPa, specific density 2 g/cm$^3$, shear strength of the joint between the rods 1 and the structural skin 23 MPa and compressive strength of the matrix material 50 MPa. After the structural skin 2 solidifies a firm, cantilever hollow panel 10 is formed, in which induced stress forces are transferred from one supporting rod 1 to the other and to the entire surface layer of the lightweight structural element.

The material of the structural skin 2 is made of polymer modified cement and webbing. The matrix may contain corrosion inhibitors, glass, polyester, nylon, polypropylene or other fibres, like carbon fibres, etc. The webbing may be woven or not woven.

The supporting rods 1 after mutual interconnection are covered with a further layer 6 of thickness 8.3 mm, of direct tensile strength 3.5 MPa, tensile strength in bending 8.3 Mpa, modulus of elasticity 13.8 GPa, specific density 2 g/cm$^3$. The shear strength of the joint between supporting rods 1 and adhesive structural skin 2 is 2.2 MPa and the pressure strength of the matrix material is 25.1 MPa. Another layer 6 can be sprayed on, as is usually done with mortar.

The core 5, which may, but need not be used, is made of polystyrene foam. The polystyrene block has common dimensions 1200×2400×100 mm.

The lightweight structural element to be used on the roof is produced in similar ways, as the wall element. It has the shape of panel 10 and is formed of two supporting rods 1 of galvanised steel, the structural skin 2 and the core 5. In this case the structural skin 2 must be made so that it will resist climatic deterioration due to rain, wind etc. The supporting rods 1 of cross section "U" are arranged with their open sides facing each other. Supporting rods 1 are at their ends interconnected by cross burs. To the surface of supporting rods 1 a structural skin 2 is joined adhesively. The material of this structural skin 2 is 1.5 mm thick, has direct tensile strength 5.8 Mpa, tensile strength in bending 11.5 MPa, modulus of elasticity 20.1 Gpa specific density 2.1 g/cm$^3$, the shear strength of the joint between the surface layer and the supporting rods 1 is 2.1 MPa and the pressure strength of the matrix material is 35.8 MPa. After the structural skin 2 solidifies a firm, cantilever hollow panel 10 is formed, in which induced stress forces are transferred from one supporting rod 1 to the other and at the same time to the entire surface layer of the lightweight structural element. The core 5 is of lightened material. The roof panels 10 are attached to the wall panels 10 by further mechanical fixtures.

The lightweight structural element for floors is in principle also manufactured in the same way as the wall element. It has the shape of panel 10 and is made of two supporting rods 1 made of galvanised steel, a structural skin 2 and core 5. In this case the supporting rods 1 are 150 mm high. After the basic layer 7 of material identical with the material of the structural skin 2 material is applied, grooves are made in the upper surface of layer 7 in order to make the poured mortar layer 8 adhere better to the structural skin 2. The poured mortar layer 8 can be from 10 to 50 mm thick.

In places, where the temperature difference is excessive, stresses could be induced in the lightweight structural element. In this case it is better to replace the supporting rods 1 of profile "U" by supporting rods 1 of profile "L". Panels 10 of this construction are better able to distribute by means of the structural skin 2 stress induced by external influences. Cold may furthermore induce condensation of moisture and icing on the internal part of the frame. Using rods Cold may furthermore induce condensation of moisture and icing on the internal part of the frame. Using supporting rods 1 of profile "L" prevents this. Structural skin 2 transfers shearing stress as well as pulling stress. Shear stress can be transferred from one "L" supporting rod 1 to its neighbour on the side wall through some other materials like plasts, epoxy impregnated fibres, epoxy resin polyester etc.

The above mentioned facts make it clear, that the lightweight structural element can be implemented and used either in the form of structural skin 2, possible structural skin 2 and a further layer 7, i.e. as a hollow element, or with a core 5 without structural skin 2, core 5 with structural skin 2, core 5 and a further layer 7, or in the form core 5, structural skin 2 and a further layer 7.

The lightweight structural element according to this invention is manufactured so, that two "U"-profile supporting rods 1 are placed facing each other, their mutual position is fixed by mounting cross bars in place using junction pieces, bolts or screws and nuts and over this assembly structural skin 2 is put in place. In case "L" profile supporting rods 1 are used, the first step is to fix their position and the remaining operations are the same.

Lightweight structural elements according to this invention are assembled to each other so that neighbouring panels 10 are positioned next to each other and fixed in place using junction pieces and bolts or screws., A strip 3 of width about 200 mm of material identical with the material of the structural skin 2 is placed on this assembly of neighbouring elements. Junction pieces and bolts or screws remain in place, but their function is minimised, because the strip 3 firmly joins the elements together. In the next operation further strips 4 of material identical to the material of the structural skin 2 are placed on the remaining exposed parts of the supporting rods 1 and the cross bars 12. This ensures better adhesive joints between the surface of supporting rods 1 and the further layer 7. Finally a further layer 7 from 10 to 20 mm thick is applied to the assembled components.

Some panels 10 may contain openings for windows, doors etc. Electrical and other installations are embedded in the wall—in the core 5 the installation is covered by a strip of material identical to the material forming the structural skin 2.

Industrial Applicability

The lightweight structural element, especially for use in building construction, and the method of constructing buildings using the elements according to this invention, will find use above all in construction of family houses, industrial, commercial, business and dwelling houses of up to about three floors. The lightweight structural elements themselves can also be used as filler panels in constructions using reinforced concrete or steel skelets.

I claim:

1. A light weight structural element in the shape of a panel, especially for building construction, comprising:

a support structure containing at least two supporting rods, which at their ends are interconnected by cross-bars, between the supporting rods and the cross-bars is a core and surfaces of the supporting rods are interconnected by an adhesive structural skin made from material of thickness between 0.5 and 5 mm, of direct tensile strength from 5 to 35 MPa, tensile strength in bending from 5 to 45 MPa, modulus of elasticity from 2 to 30 GPa, specific density from 1 to 2.7 g/cm$^3$, the shear bond strength of a junction between the structural skin and the support rods is from 1 to 5 Mpa;

wherein the adhesive structural skin is arranged around the supporting rods so as to form a box about the supporting rods.

2. The lightweight structural element according to claim 1, wherein the at least two supporting rods have a "U" profile and face each other with their open sides.

3. The lightweight structural element according to claim 1, including four supporting rods each having an "L" profile, and being arranged to face each other with their open sides.

4. The lightweight structural element according to claim 1, wherein the core or the rods are covered with a further layer from 5 to 50 mm thick, of direct tensile strength from 0.1 to 10 MPa, tensile strength in bending from 2 to 15 MPa, modulus of elasticity from 2 to 45 GPa, specific density of the matrix material from 1 to 2.7 g/cm$^3$, the shear strength of the junction to the adhesive structural skin is from 0.1 to 5 MPa.

5. The lightweight structural element according to claim 1, wherein the core is made of polystyrene foam, extruded polystyrene, polyurethane foam, mineral wool, poro-cement, or poro-silicates.

6. The lightweight structural element according to claim 1, wherein the core is made of paper board, refuse material, earth, cellulose or mineral fibers.

7. The lightweight structural element according to claim 1, further comprising an additional layer to the structural skin, the additional layer having grooves for holding applied mortar.

8. A construction technique of constructing buildings using the lightweight structural elements according to claim 1, wherein the lightweight structural panels are adapted to be attachable to support studs, and a layer identical to the structural skin material is applied to the support studs or at the structural skin of at least two neighbouring panels.

9. The construction technique of constructing buildings according to claim 8, wherein a further layer is applied at least to two neighbouring panels.

10. The light weight structural element according to claim 1, wherein the core has a honeycomb construction.

11. The lightweight structural element of claim 1, wherein the adhesive structural skin is made from a material comprising polymer modified cement and webbing.

12. A light weight structural element in the shape of a panel comprising:

at least two supporting rods connected at their ends by cross-bars; and an adhesive structural skin interconnecting surfaces of the supporting rods, the adhesive structural skin being made from a material of thickness between about 0.5 mm and about 5 mm, of direct tensile strength from about 5 MPa to about 35 MPa, of tensile strength in bending from about 5 MPa to about 45 MPa, of a modulus of elasticity from about 2 GPa to about 20 GPa, and of a specific density from about 1 g/cm$^3$ to 2.7 g/cm$^3$;

wherein the bond strength of a junction between the structural skin and the supporting rods is from 1 to 5 Mpa;

wherein the adhesive structural skin is arranged around the supporting rods to form a box about the supporting rods.

13. The light weight structural element of claim 10, wherein the adhesive structural skin is made from a material comprising polymer modified cement and webbing.

14. A light weight structural element in the shape of a panel, especially for building construction, comprising:

a support structure containing at least two supporting rods having surfaces, which at their ends are interconnected by cross-bars, the surfaces of the supporting rods are interconnected by an adhesive structural skin made from a material of thickness between 0.5 and 5 mm, of direct tensile strength from 5 to 35 MPa, tensile strength in bending from 5 to 45 MPa, modulus of elasticity from 2 to 30 GPa, specific density from 1 to 2.7 g/cm$^3$, and the shear bond strength of a junction between the structural skin and the support rods is from 1 to 5 Mpa;

wherein the adhesive structural skin is arranged around the supporting rods so as to form a box about the supporting rods.

15. The lightweight structural element of claim 14, wherein the adhesive structural skin is made from a material comprising polymer modified cement and webbing.

* * * * *